United States Patent [19]

Pike

[11] 4,170,865

[45] Oct. 16, 1979

[54] YARN SLUBBING DEVICE

[75] Inventor: Herbert J. Pike, Martinsville, N.J.

[73] Assignee: J. P. Stevens & Co., Inc., New York, N.Y.

[21] Appl. No.: 885,148

[22] Filed: Mar. 10, 1978

[51] Int. Cl.[2] ..... D02G 3/34; D02G 3/36; D02G 1/16

[52] U.S. Cl. ..... 57/6; 28/252; 57/91

[58] Field of Search ..... 28/252, 253; 57/6, 91, 57/34 B; 112/79 A

[56] References Cited

U.S. PATENT DOCUMENTS

| | | | |
|---|---|---|---|
| 2,880,684 | 4/1959 | Masland | 112/79 A |
| 3,805,344 | 4/1974 | Bartnicki et al. | 28/252 |
| 3,981,253 | 9/1976 | Neyraund | 112/79 A |

FOREIGN PATENT DOCUMENTS

| | | | |
|---|---|---|---|
| 242085 | 12/1962 | Australia | 28/252 |
| 1271414 | 7/1961 | France | 57/34 B |
| 500307 | 1/1971 | Switzerland | 57/91 |
| 828641 | 2/1960 | United Kingdom | 57/34 B |

*Primary Examiner*—Robert Mackey
*Attorney, Agent, or Firm*—Michael T. Frimer; Charles Stein

[57] ABSTRACT

This invention is directed to an improved apparatus in which a fluid jet texturing device is used to produce a composite novelty yarn having slubs of selectively varied size distributed with selectively varied spacing along the linear length of the yarn. The apparatus includes at least two feed rolls to serve to feed yarn to the texturing jet, one of said rolls being operable to feed yarn at a higher speed than the other roll or rolls. An actuator arm is provided having an idler roll at one end. The first yarn is directed into contact with a slower feed roll while a second yarn is directed into contact with the idler roll. The actuator arm is selectively moved so as to first press the second yarn against the relatively fast roll and then press this yarn into contact with a slower feed roll to thereby vary the speed at which the second yarn is fed into the texturing jet.

4 Claims, 6 Drawing Figures

YARN SLUBBING DEVICE

FIELD OF THE INVENTION

This invention relates to an apparatus for producing a composite slub yarn by feeding two yarns into a texturing jet while selectively varying the feeding speed of one of the yarns.

BACKGROUND OF THE INVENTION

It is known to prepare slub yarns by combining two yarns in a fluid texturing jet while periodically changing the feed rate of at least one of the feed yarns into the jet. It is also known to produce slubs at varied intervals in order to prevent an undesirable repeating pattern in fabric made from the slubbed product.

U.S. Pat. No. 3,091,909 discloses an apparatus for preparing a composite slub yarn by combining a core yarn and a second yarn in an air jet, the apparatus including a means for randomly actuating a device that changes the feed rate of the second yarn into the air jet so as to periodically feed an excess of the second yarn. In one embodiment this is accomplished by feeding the second yarn through a tension device which slows the speed of the yarn and then periodically releasing the tension device to give an increase in yarn speed. In a second embodiment, the actuating device controls a gear mechanism that changes the feed rate of the second yarn. Neither of the embodiments can control the speed of the second yarn rapidly enough to give short slubs when the yarns are fed at high rates of speed.

U.S. Pat. No. 3,805,344 describes an apparatus for preparing a composite slub yarn by combining an effect yarn and a core yarn in an air jet using a pivotally mounted rocker bracket to selectively press the effect yarn against different feed rolls which are rotating at different speeds. The rocker bracket is pivotally supported intermediate its ends and has first and second idler rolls mounted on opposite ends. By rotating the rocker bracket, the first and second idler rolls are made to alternately press the effect yarn against the high speed and low speed feed rolls, thus changing the feeding speed of the yarn. While this system gives very good control over the length of the slubs, there is a problem of filament breakage when the effect yarn contains fine denier filaments. This breakage is caused by the fact that when the idler roll is moved out of contact with the effect yarn its rotational speed slows substantially or even stops and then when the idler roll is moved back into contact with the rapidly moving effect yarn there is a substantial strain on the filaments as the idler roll is brought back up to speed.

SUMMARY OF THE INVENTION

The present invention is directed to an apparatus for producing a novelty yarn having slubs of selectively varied size distributed along the linear length of the yarn so that the distances between the slubs are selectively varied, said apparatus being capable of operating at high yarn speeds while giving sharp control over the length of the slubs and without breaking the fine denier filaments in the feed yarn. In accordance with the present invention, an effect yarn and a core yarn are fed from supply sources into a fluid texturing jet wherein the yarns are combined into a composite yarn. A first feed roll is positioned between the core yarn supply source and the air jet and is operational to feed yarn to the jet at a first rate of speed. Guide means are provided to direct the core yarn into continuous contact with the first feed roll so that the core yarn is continuously fed to the jet at this first rate of speed.

A second yarn feed roll is positioned so that its peripheral surface is a short distance from the peripheral surface of the first feed roll. The second feed roll is operable to feed yarn to a texturing jet at a higher speed than the first roll. An actuator arm having an idler roll at one end is positioned between the feed rolls and guide means are provided for directing the effect yarn into continuous contact with this idler roll. Means are provided for selectively moving the actuator arm so that the idler roll alternately presses the effect yarn against the first and second feed rolls. If desired, the apparatus can be constructed so that a third feed roll is used to provide the slower feed rate of the effect yarn. In such an embodiment the idler roll of the actuator arm alternately presses the effect yarn against the second and third feed rolls. The third roll can be mounted on the same drive shaft as the first feed roll and can have the same or somewhat different peripheral speed depending on the relative diameters of the two rolls. If desired, a relatively large diameter third roll can be mounted on the same drive shaft as the first roll and can be used to provide the higher effect yarn feed rate.

In operation slubs are produced by moving the idler roll so that it presses the effect yarn against the fast feed roll, thus feeding a greater amount of this yarn to the texturing jet than core yarn. The slub is ended by moving the idler roll so that it presses the effect yarn against a slower feed roll to thereby feed the effect yarn at a slower speed. Movement of the idler roll is controlled so that both the lengths of the slubs and the distances between the slubs can be selectively varied. The feeding speed of the slower feed roll for the effect yarn is preferably within the range of $\pm 15\%$ of the feed speed of the core yarn. The feeding speed of the fast feed roll for the effect yarn is preferably 2 to 300% faster than the feeding speed of the slow feed roll for the effect yarn and 10 to 300% faster than the feeding speed of the core yarn feed roll.

The distance that the idler roll travels in moving from one feed roll to the other is relatively small and the movement is relatively fast. Thus, the time of movement is very short and sharp control of the slub length is obtained. Additionally, the idler roll is always rotating and is always in contact with the effect yarn. Thus, in the present apparatus there are never any strong shearing forces such as created by the apparatus of U.S. Pat. No. 3,805,344 when the effect yarn is contacted with a new idler roll and the present apparatus can be used with fine filaments without excessive filament breakage. Additionally, in the preferred embodiment of the present invention, the effect yarn is always carried into contact with the surface of the more rapidly rotating feed roll, the surface of the roll slipping over the yarn when the idler roll is not pressed against the fast feed roll to form a nip. This further reduces the shearing force of the yarn during the changing of the feeding speeds.

DETAILED DESCRIPTION OF THE INVENTION

Figure 1:
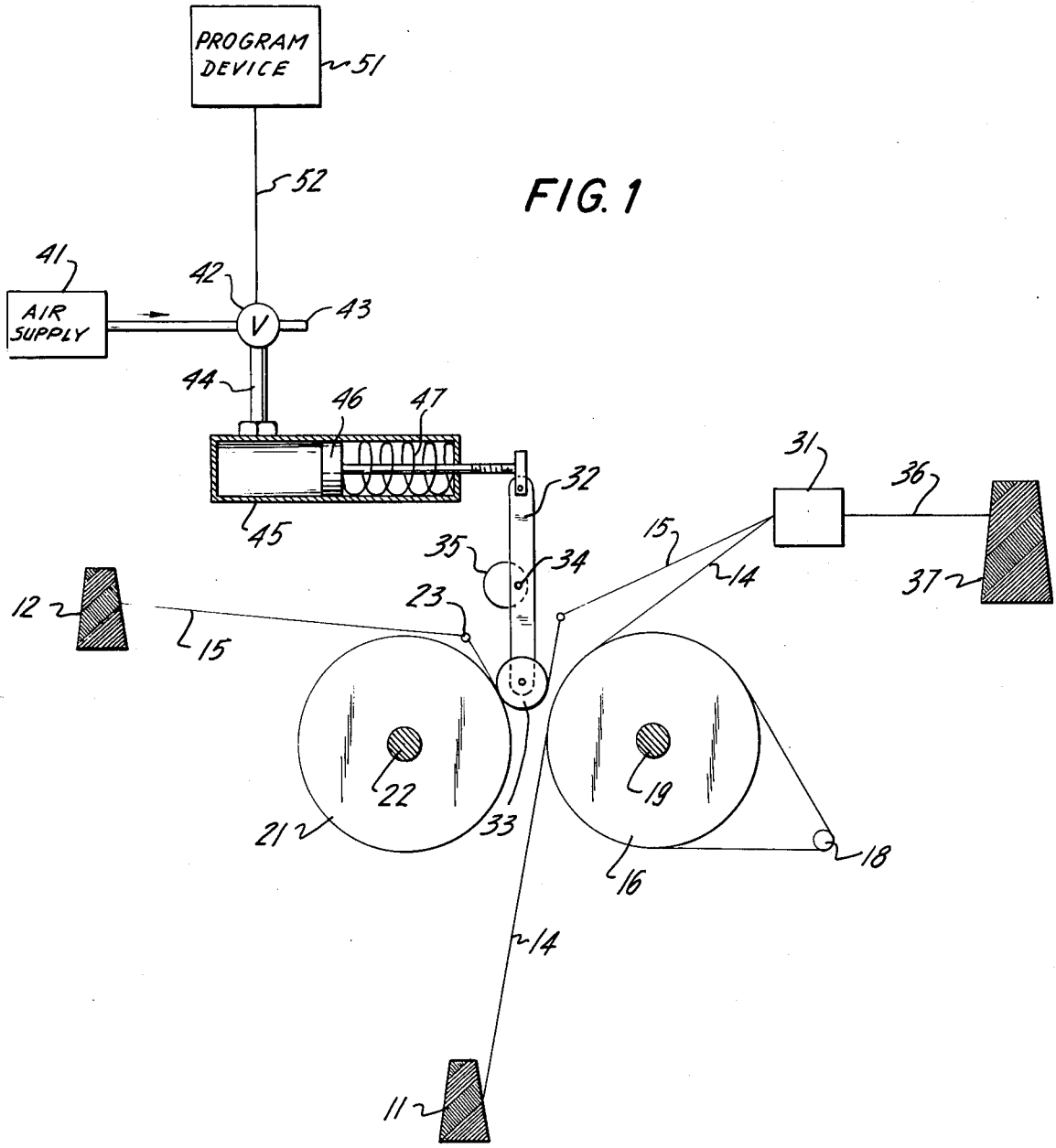
FIG. 1 is an elevational schematic view of one embodiment of an apparatus of the present invention.
Figure 2:
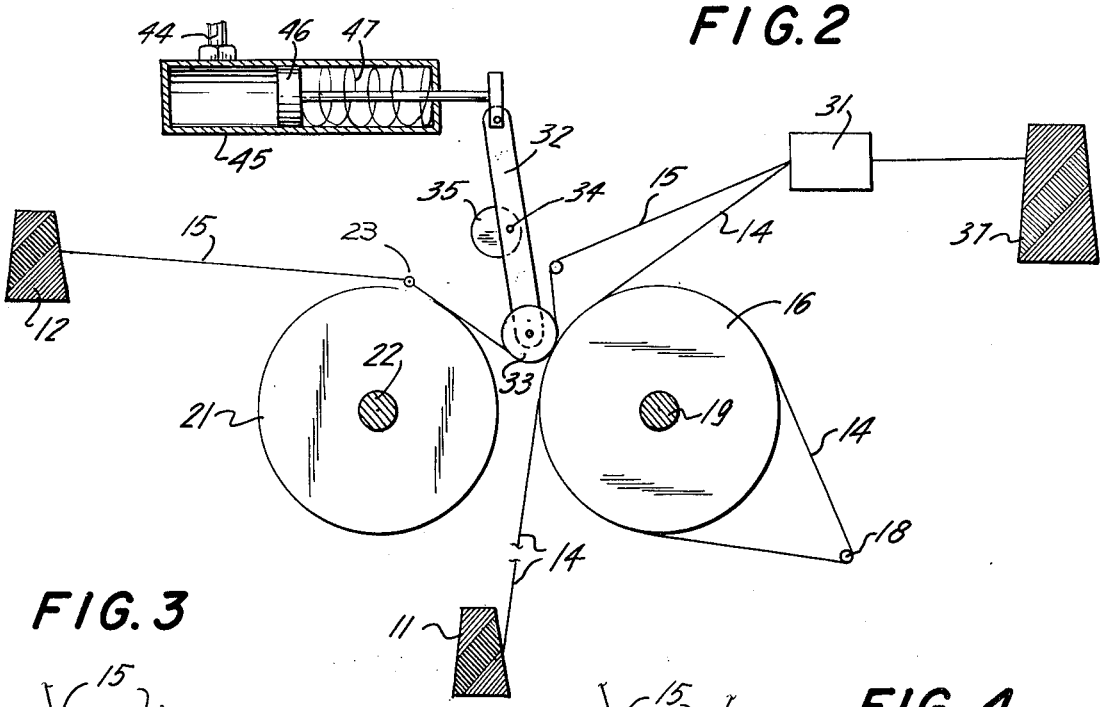
FIG. 2 is an elevational schematic view of a portion of the apparatus of FIG. 1 showing a different operational position of the elements of the apparatus.
Figure 3:
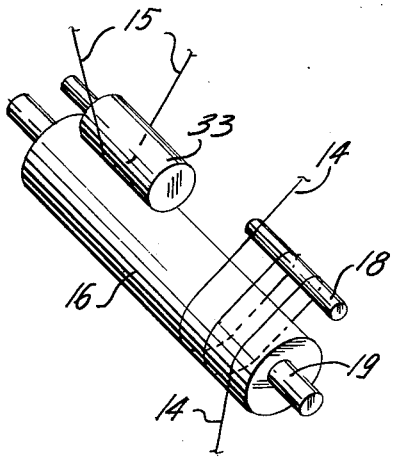
FIG. 3 is a perspective view of a portion of the yarn feeding system of the apparatus of FIG. 1.

Referring to FIGS. 1, 2 and 3 there is shown an embodiment of an apparatus of the present invention suitable for producing a composite novelty yarn having slubs of random size randomly distributed along the linear length of the yarn. In the embodiment shown, the core yarn (14) is fed from a supply source (11) to feed roll (16) which is mounted on drive shaft (19). The core yarn (14) passes partially around roll (16) and over a godet idler roll (18) and then back to roll (16) from which it is fed to air jet (31).

Effect yarn (15) is fed from supply source (12) to guide (23) and then to the surface of feed roll (21) which is mounted on drive shaft (22) and is rotated at a higher peripheral speed than feed roll (16). The effect yarn (15) next passes around idler roll (33) which, as discussed below, can selectively press yarn (15) against either feed roll (16) or (21). The path of yarn (15) between guide (23) and idler roll (33) is such that yarn (15) always contacts the surface of feed roll (21). When idler roll (33) presses yarn (15) against roll (16), as shown in FIG. 2, the surface of the more rapidly rotating feed roll (21) slides over the surface of the yarn.

Idler roll (33) is mounted on one end of actuator arm (32) and the opposite end of the actuator arm is attached to the piston (46) of the air cylinder (45). The actuator arm (32) is pivotally mounted in its center portion on shaft (34) which is attached to adjustable cam (35) so that movement of the piston (46) moves idler roll (33) between the surfaces of feed rolls (16) and (21). A spring (47) urges the piston in a direction which presses idler roll (33) against the surface of roll (16) as shown in FIG. 2. The introduction of air pressure into cylinder (45) moves the piston into the position shown in FIG. 1 wherein idler roll (33) is pressed against feed roll (21).

In operation, air is fed from air supply (41) to valve (42) which is controlled by programming device (51). Electric signals from programming device (51) are carried to the valve (42) by an electric wire (52) and switch the valve between two positions. In one position the air supply (41) is connected to the cylinder (45) and air flows through inlet pipe (44) and moves the piston into the position shown in the figure whereby the idler roll (33) is pressed against roll (21). Since roll (21) has a higher peripheral speed than roll (16) an excess of effect yarn relative to the core yarn is fed to air jet (31) when the valve is in this position. In the second position of of the valve (42), the air supply is blocked from cylinder (45) and outlet (43) is connect to cylinder (45) so that the air pressure in the cylinder is released and spring (47) moves actuator arm (32) to the position in which idler roll (33) presses yarn (15) against feed roll (16). Effect yarn (15) and core yarn (14) are fed into air texturing jet (31) in which they are combined into a composite yarn (36) which is then wound on spool (37) driven by a winder. When idler roll (33) presses effect yarn (15) against roll (21) the excess of effect yarn fed to the air jet forms a slub in composite yarn (36) while non-slub portions of composite yarn are formed when idler roll (33) presses effect yarn (15) against feed roll (16).

Figure 4:
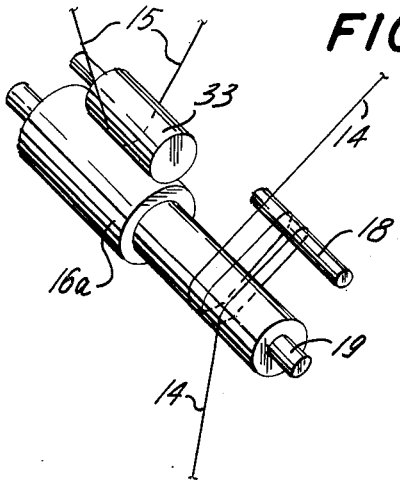
FIG. 4 is a perspective view illustrating a modified form of yarn feeding system.

Valves and air cylinders of the types used in the apparatus of the figure are readily available commercial products. An example of a suitable valve is the Clippard Minimatic Electronic Valve EV-3-24 described on page 410 of the Airoyal Company Fluid Power Digest, Catalog 76, published 1975 by the Airoyal Company, Maplewood, N.J., while an example of a suitable air cylinder is the Clippard Minimatic Sub-Miniature Cylinder SM-6 described on page 351 of the same catalog. A preferred type of programming device is shown in FIG. 4 of of U.S. Pat. No. 3,262,177. Such devices include a rotating disc having a face on which there is a pattern of reflective and non-reflective areas. A light source directs a narrow beam of light at a spot on the disc face and a photoelectric cell is positioned to receive the reflection of the beam when a reflective area of the face passes this spot. Variations in the lengths of the slubs can be produced by varying the widths of the reflective lines shown in FIG. 4 of the patent. Variations in the distances between slubs are obtained by varying the distances between reflective lines. Additionally, the reflective lines can be short and positioned at different distances from the center of the disc and the light source and photoelectric cell mounted on a device which oscillates relative to the center of the disc. In this way, different reflective lines are struck by the light beam on different revolutions of the disc and a greater variety in both the distance between the slubs and the lengths of slubs can be obtained. The instantaneous variations of the photoelectric cell are amplified and the resulting signals used to activate the valve mechanisms, it being preferred to have the reflected light from the reflective line activate the equipment into the slub producing position.

Air jets suitable for use in the apparatus are described in U.S. Pat. No. 3,545,057 of Lubach and U.S. Pat. No. 3,577,614 of Price. The yarns employed are continuous multifilament yarns of synthetic polymer or glass in which the denier of the individual filaments can be as low as 2 denier. The composite yarn product can be taken up on spool (37) at speeds as high as 800 yards per minute. The position of the idler roll (33) can be adjusted relative to feed rolls (16) and (21) by moving adjustable cam (35). The means of attachment between piston (46) of cylinder (45) and actuator arm (32) is adjustable to permit such movement.

Figure 5:
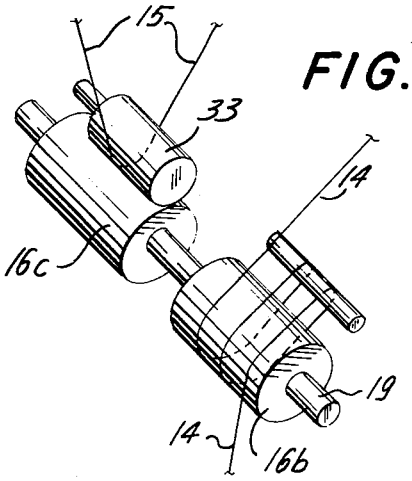
FIG. 5 is a perspective view illustrating another modified form of yarn feeding system.
Figure 6:
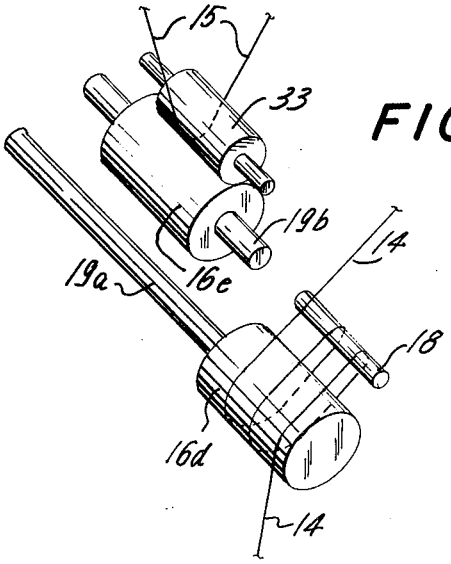
FIG. 6 is a perspective view illustrating a further modified form of yarn feeding system.

As illustrated in FIG. 4, the operation of the apparatus can be varied by replacing roll (16) with a roll (16*a*) sectioned to two diameters for the core and effect yarns. Additionally, as shown in FIG. 5, roll (16) can be removed and different rolls (16*b*) and (16*c*) can be mounted on shaft (19) to feed each of the yarns. The apparatus can be further varied, as shown in FIG. 6, by mounting separate rolls (16*d*) and (16*e*) for the core and effect yarns on separate shafts (19*a*) and (19*b*).

EXAMPLE

The apparatus used in this example is that shown in the figure with valve (42) being a Clippard Minimatic Electronic Valve EV-3-24, air cylinder (45) being a Clippard Minimatic Sub-Miniature Cylinder SM-6 and the air jet (31) being the jet described in U.S. Pat. No. 3,545,057. Programmer (51) was the programmer shown in FIG. 4 of U.S. Pat. No. 3,262,177 except that the reflective lines on the pattern disc were short lines having different widths and the light source and photoelectric cell were mounted on an oscillating device so as to vary the distance from the center of the disc and the point on the disc struck by the light beam.

Both the core yarn and the effect yarn were 70 denier 17 filament nylon yarn. The feed rate of rolls (16) and (21) were, respectively, 197 meters per minute and 453 meters per minute, the winding rate on spool (37) was 155 meters per minute and the air pressure in the air jet was 120 p.s.i. A composite novelty yarn was obtained having slubs of varied length distributed along the linear length of the yarn with varied spacing. There was little or no breakage of individual filaments in the composite product.

It will be apparent that many modifications and variations can be effected without departing from the scope of the novel concepts of the present invention and the illustrative details disclosed are not to be construed so as to impose undue limitations on the invention.

I claim:

1. An apparatus for producing a composite novelty yarn having slubs of selectively varied size distributed along the linear length of the yarn with selectively varied spacing, said apparatus comprising:

(a) A fluid texturing jet for combining a multifilament core yarn and a multifilament effect yarn into a composite yarn;

(b) Yarn supply sources for supplying said core yarn and said effect yarn to said texturing jet;

(c) Means to feed said core yarn to said jet at a constant feeding speed;

(d) Feed roll means for said effect yarn including a slow feed roll operable to feed said effect yarn to said jet at a speed within the range of ±15% of said core yarn feeding speed, and a fast feed roll spaced from said slow feed roll and operable to feed said effect yarn at a speed which is at least 10% faster than said core yarn feeding speed and at least 2% faster than the feeding speed of the effect yarn slow feed roll;

(e) An actuator arm which is pivotally mounted in its center portion and has an idler roll at one end and an air cylinder device attached to the other end which pivotally moves said actuator arm when air is introduced into or released from said air cylinder;

(f) Guide means directing said effect yarn into continuous contact with said idler roll, and (g) Means to control the air flow into and out of said air cylinder to selectively move said actuator arm so that said idler roll alternately presses said effect yarn into engagement with said slow feed roll and said fast feed roll to thereby vary the speed at which the effect yarn is fed to the jet.

2. An apparatus as claimed in claim 1 wherein said effect yarn is in continuous contact with said fast feed roll, the surface of said fast feed roll slipping over the surface of the effect yarn when the speed of said effect yarn is controlled by being pressed against the slow feed roll by said idler roll.

3. An apparatus as claimed in claim 1 wherein said means to feed said core yarn comprises a core yarn feed roll which is separate from the effect yarn feed rolls.

4. An apparatus as claimed in claim 3 wherein said core yarn feed roll is mounted on the same drive shaft as one of the effect yarn feed rolls.

* * * * *